US011185159B2

(12) United States Patent
Hotes et al.

(10) Patent No.: US 11,185,159 B2
(45) Date of Patent: Nov. 30, 2021

(54) FOLDING, HARD-WALL LOCKER

(71) Applicant: Alaska Structures, Inc., Kirkland, WA (US)

(72) Inventors: Richard W. Hotes, Anchorage, AK (US); Michael Vesper, Anchorage, AK (US)

(73) Assignee: Alaska Structures, Inc., Kirkland, WA (US)

( * ) Notice: Subject to any disclaimer, the term of this patent is extended or adjusted under 35 U.S.C. 154(b) by 0 days.

(21) Appl. No.: 16/793,711

(22) Filed: Feb. 18, 2020

(65) Prior Publication Data

US 2021/0251382 A1 Aug. 19, 2021

(51) Int. Cl.
*A47B 43/00* (2006.01)
*A47B 96/02* (2006.01)

(52) U.S. Cl.
CPC ..... *A47B 43/00* (2013.01); *A47B 96/02* (2013.01)

(58) Field of Classification Search
CPC ..... A47B 43/00; A47B 43/02; A47B 96/02; B65D 7/26
See application file for complete search history.

(56) References Cited

U.S. PATENT DOCUMENTS 2,187,004 A * 1/1940 Wolf ..... A47B 43/02 312/260
2,576,750 A 11/1951 Clark
2,912,271 A * 11/1959 Schaefer ..... E05B 65/025 292/336.3
2,934,389 A 4/1960 Krey
2,963,122 A * 12/1960 Jagemann ..... G07F 19/20 52/66
3,061,396 A 10/1962 Hock
3,527,339 A 9/1970 Cipolla
3,527,340 A 9/1970 Cipolla
3,644,011 A 2/1972 MacDonald
3,648,299 A * 3/1972 Durst ..... A61H 33/06 4/524

(Continued)

FOREIGN PATENT DOCUMENTS

DE 101 50 158 A1 5/2002
DE 20 2009 005 189 U1 11/2010

OTHER PUBLICATIONS

KD2GS-01 Collapsible Sheet Metal Steel Container, Maxum Hardware, https://www.maxumhardware.com/catalog/product_info.php?proucts_id=667, Jun. 18, 2019.

*Primary Examiner* — Kimberley S Wright
(74) *Attorney, Agent, or Firm* — Blank Rome LLP

(57) ABSTRACT

A folding hard-wall locker includes a frame, a front door connected to the frame for opening and closing the locker, and accordion-like folding side-walls connected to the frame. Each of the folding side-walls has first and second edges facing away from the frame. For each of the folding side-walls, the length of the first edge plus the length of the second edge is greater than the height of the door (and of the frame). In operation, the locker may be unfolded, assembled, and positioned for use within a shelter. The combined lengths of the first and second edges is greater than any dimension of the locker before the locker is unfolded from its shipping configuration. Among other things, the unfolded, assembled locker is adapted to fit beneath an angled ceiling of a flexible shelter.

12 Claims, 4 Drawing Sheets

(56) References Cited

U.S. PATENT DOCUMENTS

| | | | | |
|---|---|---|---|---|
| 3,865,269 | A | 2/1975 | Coleman | |
| 4,035,964 | A * | 7/1977 | Robinson | E04B 1/3445 52/66 |
| 5,299,704 | A | 4/1994 | Thorby | |
| 5,802,801 | A * | 9/1998 | Hohns | E05B 65/025 108/64 |
| 6,386,383 | B1 * | 5/2002 | Roudonis | B65D 88/522 220/1.5 |
| 6,948,787 | B2 | 9/2005 | McBrayer, III et al. | |
| 7,464,999 | B2 | 12/2008 | Quinn | |
| 8,256,443 | B2 | 9/2012 | Neal | |
| 9,301,603 | B1 | 4/2016 | Koehn et al. | |
| 9,700,168 | B1 | 7/2017 | Evans | |
| 2004/0150302 | A1 * | 8/2004 | McBrayer | A47B 43/00 312/258 |
| 2007/0210682 | A1 | 9/2007 | Wise | |

* cited by examiner

FOLDING, HARD-WALL LOCKER

BACKGROUND

The prior art contains various lockers, cabinets, wardrobes, and locker boxes. Examples of known devices and apparatuses are shown in U.S. Pat. No. 7,464,999 (Quinn), U.S. Pat. No. 6,948,787 (McBrayer, III et al.), and U.S. Pat. No. 5,299,704 (Thorby), and U.S. Patent Application Publication No. 2007/0210682 (Wise). Moreover, the prior art contains various shelters, including shelters made at least partially of flexible material, for use in rugged and remote conditions, and/or requiring portability and ease of shipping. Examples of known shelters are shown in U.S. Pat. No. 10,094,139 (Hotes et al.), U.S. Pat. No. 10,094,134 (Hotes et al.), and U.S. Pat. No. 9,903,136 (Hotes et al.)

SUMMARY

The present disclosure overcomes the disadvantages of the prior art to a substantial extent. The present disclosure relates to a locker for storing items, where the locker includes a frame, a front door connected to the frame for opening and closing the locker, and accordion-like folding side-walls connected to the frame. Each one of the folding side-walls may have first and second edges facing away from the frame, and for each of the folding side-walls, the length of the first edge plus the length of the second edge is greater than the height of the door (and/or of the frame).

The present disclosure also relates to a hard-wall locker folded into a shipping configuration. The locker can be unfolded from the shipping configuration into an assembled configuration, where the locker in the shipping configuration has a frame, a front door connected to the frame by a hinge, and inwardly folded side-walls connected to the frame by hinges. According to one aspect of the present disclosure, each of the folded side-walls has first and second panels hinged to each other, and the first and second panels are parallel to the door and the frame. According to another aspect of the present disclosure, the locker has an angled, upper portion which fits beneath an angled ceiling of a shelter after the hard-wall locker is unfolded into the assembled configuration.

The present disclosure also relates to a method of unfolding, assembling, and positioning a hard-wall locker for use within a shelter.

According to a preferred embodiment, a locker is provided with accordion-folding side walls so that it can be shipped in a flat configuration. The locker can be unfolded from the shipping configuration and then assembled for use. The back wall of the locker has a vertical section and a sloped section, so that the locker can fit into a space beneath a low-sloped wall/ceiling, such as the ceiling of a portable shelter. The length of the whole back wall (the vertical section plus the sloped section) is greater than that of the front wall of the locker. An advantageous feature of the preferred embodiment is that the two-piece back wall can be folded into the shipping configuration such that the length of the folded-up locker is no greater than the length (height) of the front door (or a front wall).

DETAILED DESCRIPTION

Figure 2:
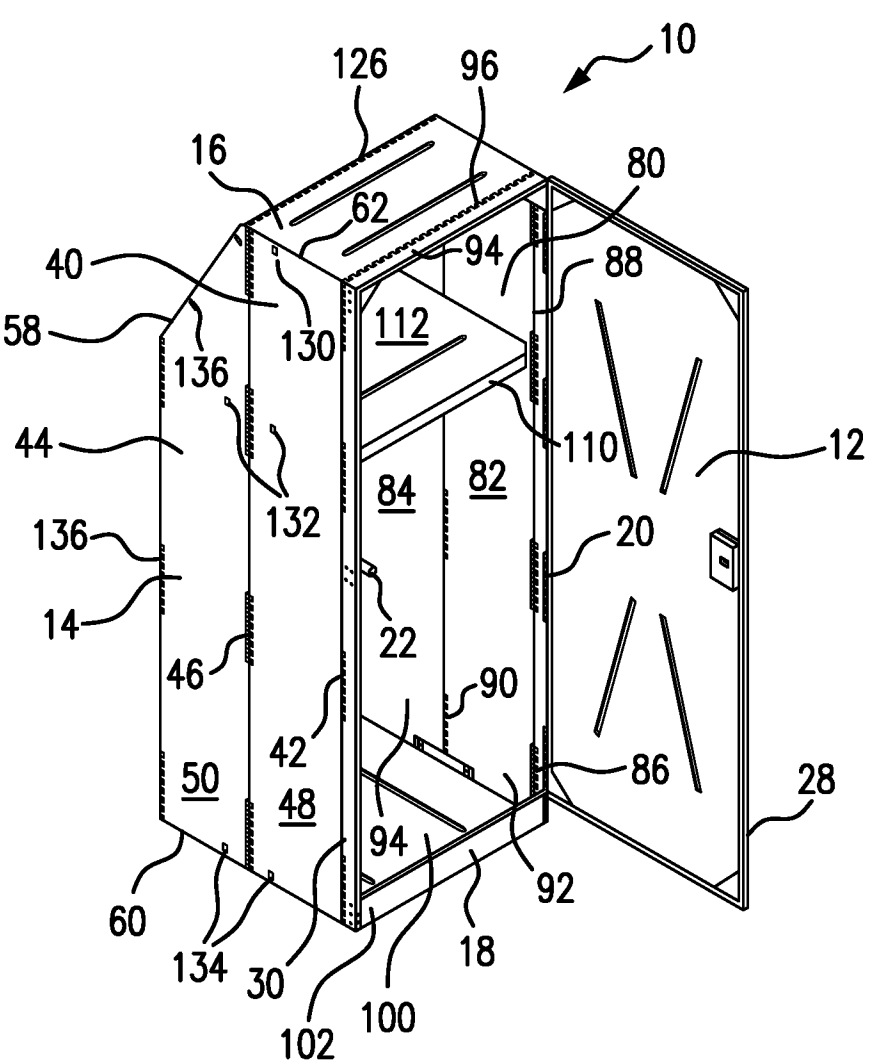
FIG. 2 is a perspective view of the folding, hard-wall locker of FIG. 1, in an open configuration.
Figure 1:
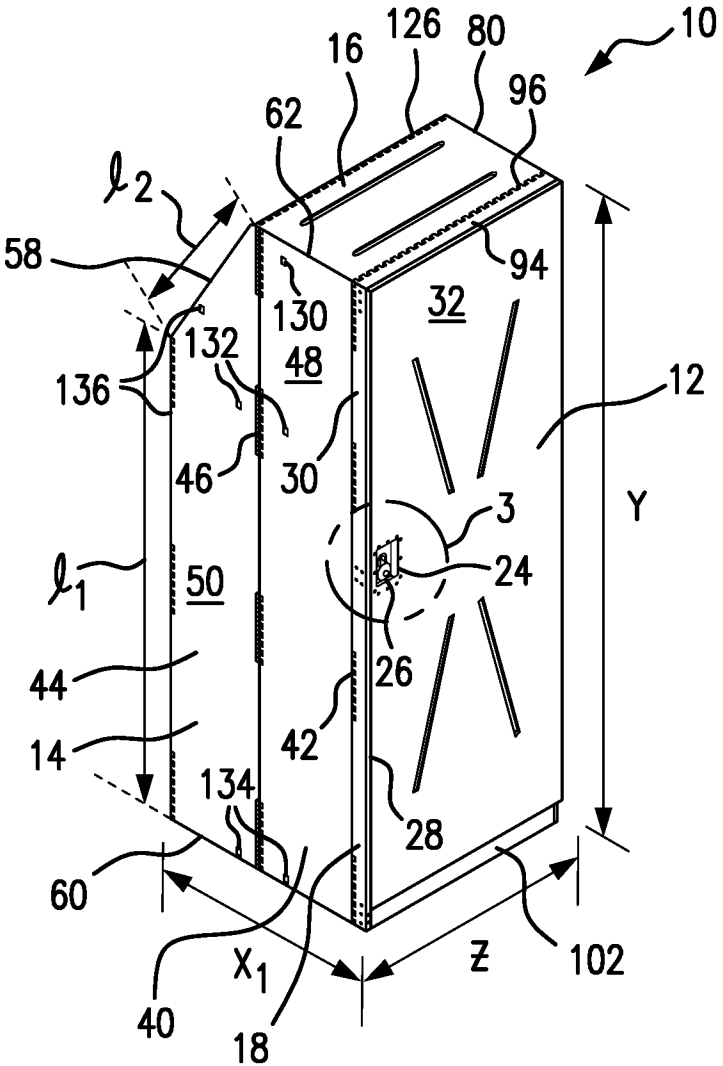
FIG. 1 is a perspective view of a folding hard-wall locker constructed in accordance with the present disclosure, in a closed configuration.

Referring now to the drawings, where like elements are designated by like reference numerals throughout, there is shown in FIG. 1 a folding, hard-wall locker 10 constructed in accordance with the present disclosure. The locker 10 has a rectangular door 12, a pentagonal side-wall member 14, and a rectangular top member 16. As illustrated in FIG. 2, the door 12 is connected to a rectangular frame 18 by a vertical hinge 20. The door 12 rotates around a vertical axis that extends through the vertical hinge 20, from the locker-open position shown in FIG. 2 to the locker-closed position shown in FIG. 1, and from the locker-closed position back to the locker-open position. When the locker 10 is in its open configuration (FIG. 2), access to the interior of the locker 10, to put items (not illustrated) into the locker 10, or to remove items from the locker 10, is provided through the frame 18. When the locker 10 is in its closed condition (FIG. 1), there is no access to the interior of the locker 10, such that items cannot be put into, or removed from, the locker 10.

Figure 3:
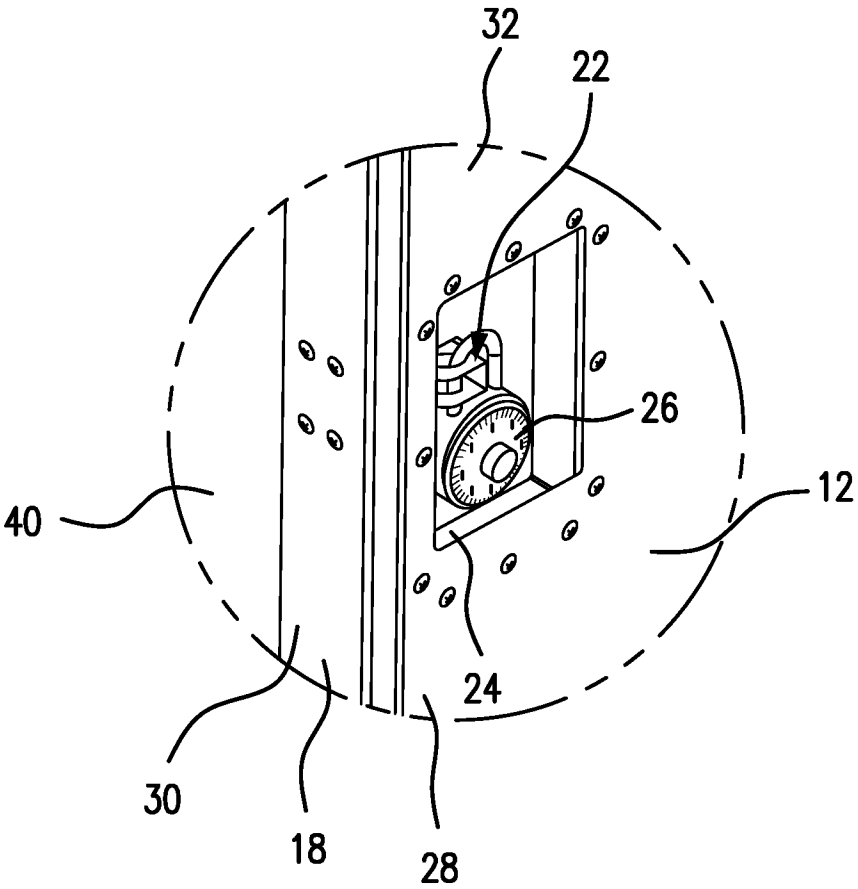
FIG. 3 is an enlarged, perspective view of a lock structure for the folding, hard-wall locker of FIG. 1, taken from circle 3 of FIG. 1.

As illustrated in FIG. 3, the frame 18 may have an eyelet 22 which extends through a corresponding opening in a recessed portion 24 of the door 12. When the locker 10 is in its closed configuration, a suitable locking mechanism, such as a padlock 26, may be located within the recessed portion 24, with a shackle of the padlock 26 extending through the eyelet 22, to prevent the left edge 28 of the door 12 from moving away from the left edge 30 of the frame 18. Thus, the locker 10 is shown in a locked condition in FIGS. 1 and 3, and in an unlocked condition in FIG. 2. When the locker 10 is in the locked condition, a human operator (not shown) has to know and use the combination (or key) of the padlock 26 to remove the padlock 26 from the eyelet 22, before the operator can swing the door 12 open, using the vertical hinge 20, from the locker-closed configuration (FIGS. 1 and 3) to the locker-open configuration (FIG. 2).

In the illustrated example, the thickness of the padlock 26 is not greater than, or at least not materially greater than, the depth of the recessed portion 24. According to a preferred embodiment, no part of the eyelet 22 or the padlock 26 extends out of the recessed portion 24 beyond a plane which contains the essentially planar front-surface 32 of the door 10. The illustrated configuration makes it possible for the entire locker 10 to be folded into the condition illustrated in FIG. 4 with an overall thickness dimension $X_2$. According to a preferred embodiment, one inch $<X_2<$five inches, and, even more preferably, $X_2$ is about three inches, although the invention should not be limited to the details of the illustrated structure. The scope of the invention should be determined by the numbered claims that are located at the end of this specification.

Figure 4:
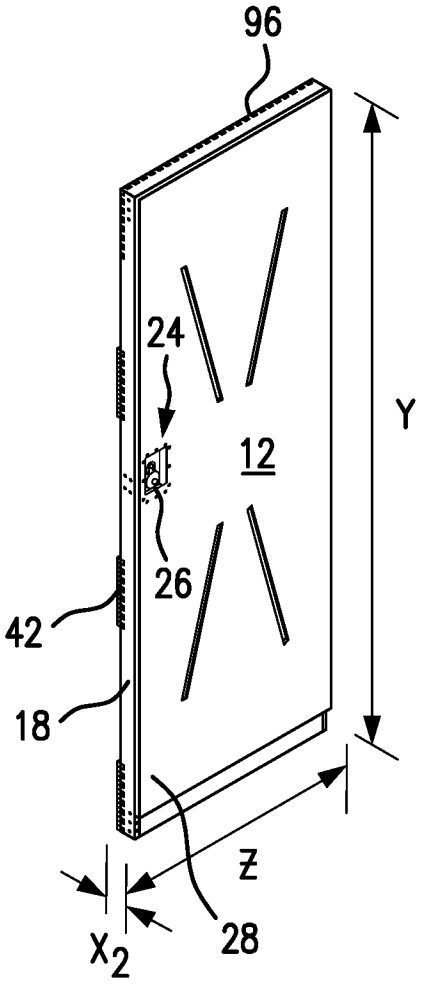
FIG. 4 is a perspective view of the folding, hard-wall locker of FIG. 1, in a completely folded, shipping configuration for storage or transport.
Figure 6:
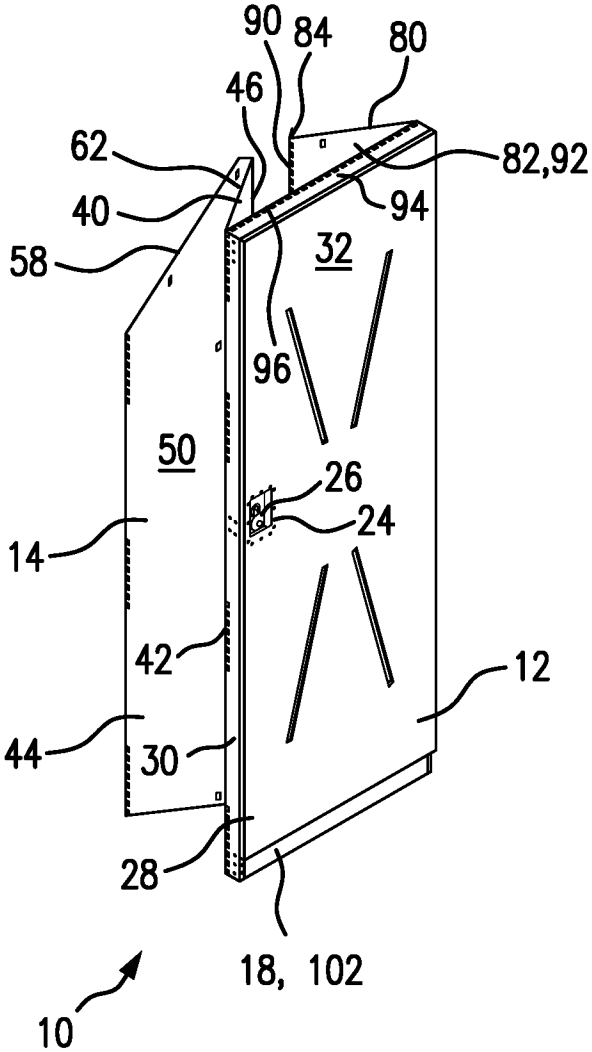
FIG. 6 is a perspective view of the folding, hard-wall locker of FIG. 1, in a second, partially unfolded configuration.
Figure 5:
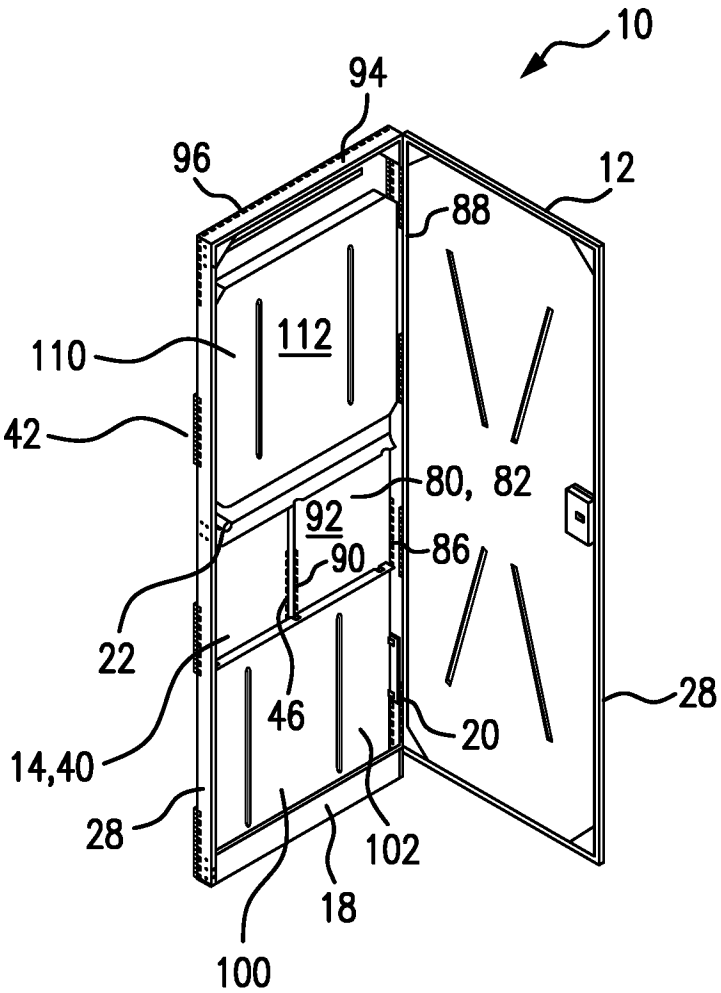
FIG. 5 is a perspective view of the folding, hard-wall locker of FIG. 1, in a first, partially unfolded configuration.

Referring again to FIG. 2, a first, rectangular panel 40 of the side-wall member 14 is connected to the frame 18 by a second vertical hinge 42. The rectangular panel 40 can rotate around the vertical axis of the vertical hinge 42, toward and away from the rear side of the frame 18. In the open configuration illustrated in FIG. 2, the rectangular panel 40 is rotated 90° away from the rear side of the frame 18, such that the rectangular panel 40 forms a right angle with the frame 18. In the folded configuration shown in FIG. 4 (and in FIG. 5), the rectangular panel 40 is substantially parallel to the frame 18. In the partially open configuration of FIG. 6, the rectangular panel 40 is about half-way between its open, side-wall position (FIGS. 1 and 2) and its fully folded position (FIGS. 4 and 5).

A second, quadrilateral panel 44 (FIG. 6) of the side-wall member 14 is connected to the first panel 40 by a third vertical hinge 46. The length (approximately =Y (FIG. 1)) of the third hinge 46 may be about the same as those of the first and second hinges 20, 42. The quadrilateral panel 44 can rotate around the vertical axis of the third vertical hinge 46, toward and away from the outer surface 48 of the first panel 40. In the unfolded configuration illustrated in FIGS. 1 and 2, the first and second panels 40, 44 are essentially co-planar. In the folded configuration illustrated in FIG. 4 (and in FIG. 5), the outer surface 50 of the second panel 44 faces and comes into contact with the outer surface 48 of the first panel 40. In the partially open configuration illustrated in FIG. 6, the second panel 44 is about half-way between its unfolded and folded configurations, relative to the first panel 40 of the side-wall member 14. Thus, the side-wall member 14, with the third vertical hinge 46, has an inwardly-folding, accordion-like structure.

The top edge 58 (FIG. 7) of the second panel 44 is not parallel to the bottom edge 60 of the second panel 44. Moreover, the top edge 58 is not parallel to the top edge 62 of the first panel 40. Instead, as discussed in more detail below, the top edge 58 of the second panel 44 is angled to approximately match the alignment of the ceiling 64 of a flexible shelter 66.

Returning now to FIGS. 2 and 4, the locker 10 has a second side-wall member 80 with first and second panels 82, 84 joined to each other by a fifth vertical hinge 90. The second side-wall member 80 is connected to the right edge 88 of the frame 18 by a fourth vertical hinge 86. The second side-wall member 80, with its two panels 82, 84, and the fourth and fifth hinges 86, 90, are essentially mirror images of the first side-wall member 14, with its corresponding panels 40, 44, and the third and second hinges 42, 46, respectively. The second side-wall member 80, like the first side-wall member 14, has a pentagonal shape, and an inwardly-folding, accordion-like structure. The third and fifth vertical hinges 46, 90 move away from each other as the locker 10 moves out of its folded configuration, and toward its assembled configuration. When the locker 10 is in the FIGS. 1 and 2 configuration, the first and second panels 82, 84 of the second side-wall member 80 are essentially coplanar. When the locker 10 is in the folded configuration illustrated in FIG. 4 (and in FIG. 5), the inner surface 92 of the first panel 82 of the second side-member 80 is essentially co-planar with the frame 18, and the outer surfaces of the two panels 82, 84 are essentially co-planar and in contact with each other.

The top member 16 is connected to an upper edge 94 of the frame 18 by a horizontal hinge 96. The terms "vertical" and "horizontal" are used herein in a relative-to-each-other sense. Items that are characterized as being vertical or horizontal are vertical or horizontal, respectively, when the locker 10 is in its upright, intended position for use, and may be in different orientations when the locker 10 is folded for shipping or in some other orientation.

The top member 16 is rotatable with respect to the frame 18 along a horizontal axis that is parallel to the width Z of the locker door 12. In the configurations illustrated in FIGS. 1 and 2, the top member 16 is horizontal. In the folded configuration illustrated in FIG. 4 (and in FIG. 5), the top member 16 is vertical and is located between the frame 18 and the first panels 40, 82 of the side-wall members 14, 80. In the FIG. 4 configuration, the top member 16 is located behind the frame 18, and the first panels 40, 82 are located behind the top member 16. The length of the top panel 16 is not greater than (or not materially greater than) the widths of the first panels 40, 82. If desired, the top member 16 may have a flat upper surface, and items (not illustrated) may be stored on top of the surface between the top member 16 and a ceiling 64 (FIG. 7) of the shelter 66.

A bottom panel 100 (FIGS. 2 and 5) is located at the bottom of the locker 10. The bottom panel 100 can be moved to the configuration illustrated in FIG. 2, where the bottom panel 100 is horizontal, from the folded configuration illustrated in FIG. 4 (and in FIG. 5), where the bottom panel 100 is vertical and located between the frame 18 and the first panels 40, 82 of the side-wall members 14, 80. In the FIG. 4 configuration, the bottom panel 100 is located behind the frame 18, and the first panels 40, 82 are located behind the bottom panel 100. In the configuration illustrated in FIG. 2, the width of the bottom panel 100 in the X direction is approximately the same as the widths of the side-wall members 14, 80 in the X direction.

A shelf 110 is located within the locker 10. The working surface 112 of the shelf 110 is vertical in the folded configuration (FIGS. 4 and 5), but horizontal in the unfolded configuration (FIGS. 1 and 2) of the locker 10. If desired, items (not illustrated) may be stored on the working surface 112, and on top of the bottom panel 100.

Figure 8:
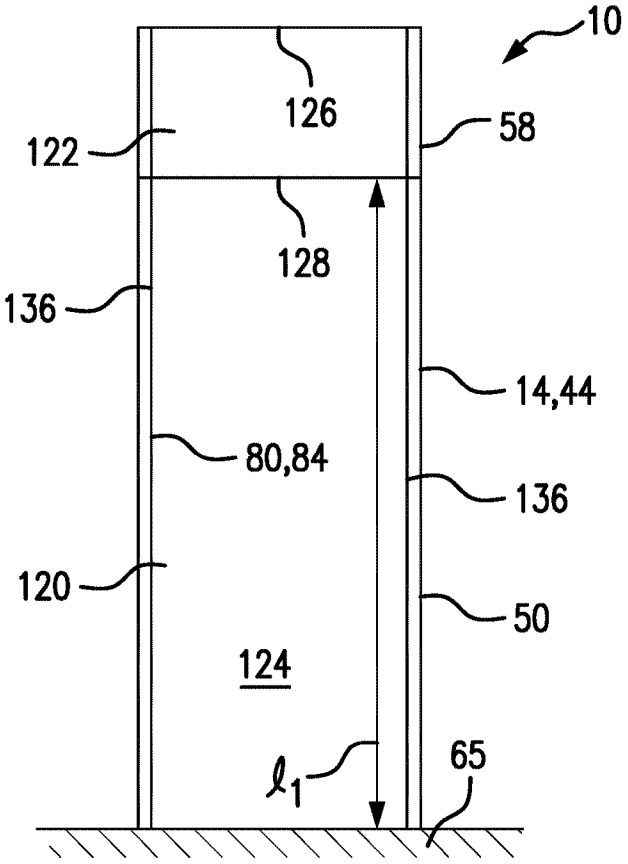
FIG. 8 is a rear view of the folding, hard-wall locker of FIG. 1.
Figure 7:
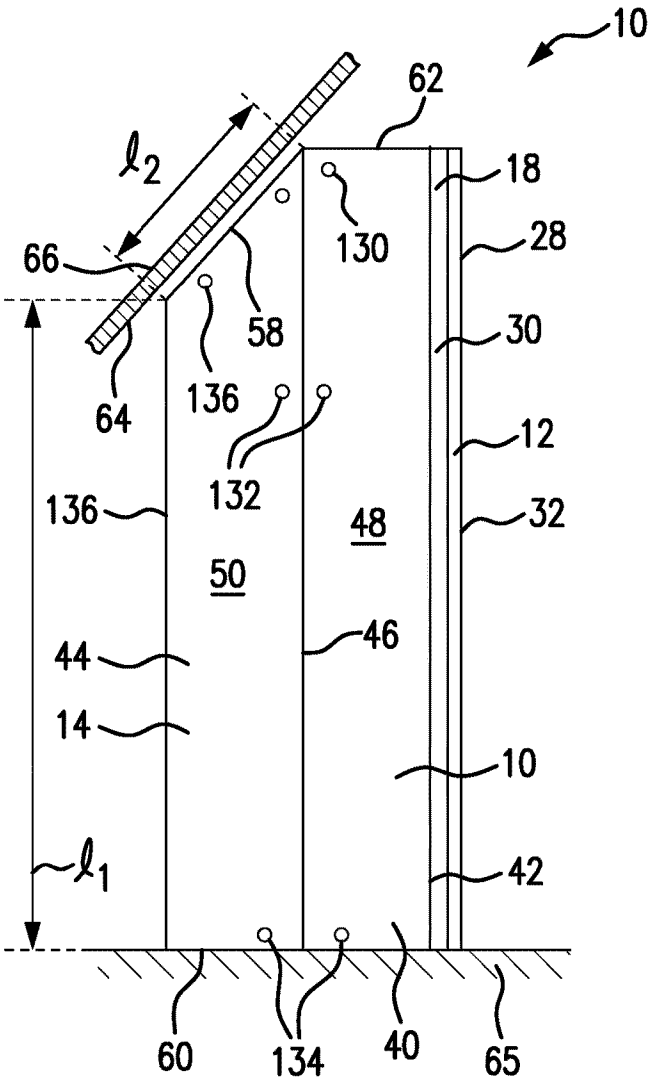
FIG. 7 is a side view of the folding, hard-wall locker of FIG. 1, in an assembled configuration, located within a flexible shelter, where a portion of the flexible shelter is shown in cross-section.

If desired, the locker 10 has a two-piece back wall 120 (FIG. 8) formed of two back panels 122, 124. The upper back panel 122 is connected to the top member 16 by a second horizontal hinge 126. The lower back panel 124 is connected to the upper back panel 122 by a third horizontal hinge 128. In the folded configuration, the back panels 122, 124 and the top member 16 are folded together and are all essentially vertical. In the unfolded configuration, the lower back panel 124 is essentially vertical while the upper back panel 122 forms approximately 45° angles with the lower back panel 124 and the top member 16, so that the upper back panel 122 is essentially aligned with the ceiling 64 of the flexible shelter 66. The floor 65 of the shelter 66 is shown in FIGS. 7 and 8.

In operation, the locker 10 may be delivered to the portable shelter 66, or some other work-site, in the folded (or shipping) condition illustrated in FIG. 4. Then, the door 12 is opened to reveal the shelf 110, the bottom panel 100, and portions of the first panels 40, 82. Then, the sidewall members 14, 80 are extended, through the configuration illustrated in FIG. 6, and from there to the configuration illustrated in FIGS. 1 and 2. Then, the top member 16 and the back wall 120 are moved to their respective open-configuration positions. The top member 16 is then secured to the first panels 40, 82 by suitable threaded connectors 130, the back wall 120 is secured to the second panels 44, 84 by suitable threaded connectors and/or hinges 136, the shelf 110 is secured to the first and second side-wall members 40, 80 by suitable threaded connectors 132, and the bottom panel 100 is secured to the side-wall members 40, 80 by suitable threaded connectors 134. Then, the door 12 is closed, the shackle of the padlock 26 is inserted through the eyelet 22, and the padlock 26 is locked, such that the locker 10 is in the assembled, closed, and secure configuration illustrated in FIG. 1.

In the assembled configuration, the length 11 of the second back panel 124 plus the length 12 of the second back panel 122 is greater than the height Y of the locker 10 in its assembled condition ($l_1+l_2>Y$). The total length $l_1+l_2$ of the back wall 120 is approximately equal to the total length of the corresponding edges of the second panels 50, 84. Yet the height Y of the locker 10 in its shipping configuration is essentially the same as the height Y of the locker 10 in its assembled configuration. Likewise, the width Z of the locker 10 in its shipping configuration is essentially the same as the width Z of the locker 10 in its assembled configuration. The depth $X_2$ of the locker 10 in its shipping configuration is much less than the depth $X_1$ of the locker 10 in its assembled configuration.

If desired, the locker 10 may be formed of sheet metal, strong plastic, or some other suitable material. The material of the locker 10 should be sufficiently rugged and durable for the locker 10 to be shipped to a remote location, and to provide adequate resistance to forced entry when the locker 10 is in its locked condition.

In summary, the locker 10, which may be used to store items (not illustrated), has a frame 18, a front door 12 connected to the frame 18 for opening and closing the locker 10, and accordion-like folding side-walls 14, 80 connected to the frame 18. In the illustrated embodiment, each one of the folding side-walls 14 has first and second edges facing away from the frame 18. The length 11 of the first edge plus the length 12 of the second edge is greater than the height Y of the frame 18/door 20.

The illustrated locker 10 has a top member 16 connected to the frame 18 by another hinge 96, and a back wall 120. In the preferred embodiment, the back wall 120 has first and second panels 124, 122, not in the same plane (the upper panel 122 is angled, neither vertical nor horizontal). The lengths of the panels 124, 122 correspond to those of the first and second edges mentioned in the preceding paragraph. If desired, the length of the first panel 124 plus the length of the second panel 122 is greater than the height of the front door 12 (and greater than the height of the frame 18).

According to another aspect of the present disclosure, a hard-wall locker 10 may be folded into a shipping configuration (FIG. 4) and configured to be unfolded from the shipping configuration into an assembled configuration (FIGS. 1 and 2). The locker 10 has a frame 18, a door 12 connected to the frame 18 by a hinge 20, and inwardly folded side-walls 14, 80 connected to the frame 18 by hinges. Each of the folded side-walls has first and second panels 40, 44, 82, 84 hinged to each other. In the shipping configuration (FIG. 4), the first and second panels 40, 44, 82, 84 are parallel to the door 12 and the frame 18. An angled, upper portion is provided for fitting beneath an angled ceiling 64 of a shelter 66 when the hard-wall locker 10 is unfolded into the assembled configuration (FIG. 7).

As mentioned above, the invention should not be limited to the details of the preferred embodiment illustrated in the drawings and described herein. Therefore, the invention is not necessarily limited to the illustrated threaded connectors and other connecting devices. As an alternative, for example, the locker 10 may be held together by snap-fit elements, rivets, ties, and/or other suitable connecting devices.

What have been described above are examples. This disclosure is intended to embrace alterations, modifications, and variations to the subject matter described herein that fall within the scope of this application, including the appended claims. As used herein, the term "includes" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed as new and desired to be protected by Letters Patent of the United States is:

1. A locker for storing items, comprising:

a frame;

a front door connected to the frame for opening and closing the locker, wherein the front door has a height; and accordion-like folding side-walls connected to the frame;

wherein each one of the folding side-walls has first and second edges facing away from the frame, wherein each of the edges has a length; and wherein, for each one of the folding side-walls, the length of the first edge plus the length of the second edge is greater than the height of the door;

wherein the locker further comprises a top member connected to the frame by a hinge;

wherein the locker further comprises a back wall; and wherein the back wall includes first and second panels, wherein the panels are not in the same plane, wherein each one of the panels has a length corresponding to the first and second edges of the folding side-walls, and wherein the first panel is connected to the second panel by a horizontal hinge.

2. The locker of claim 1, wherein the length of the first panel plus the length of the second panel is greater than the height of the front door.

3. The locker of claim 2, further comprising a shelf and a bottom member for receiving the items.

4. The locker of claim 1, further comprising a locking mechanism for securing the door to the frame in a locked configuration.

5. A hard-wall locker folded into a shipping configuration and being configured to be unfolded from the shipping configuration into an assembled configuration, the hard-wall locker comprising:

a frame;

a front door connected to the frame by a hinge; and inwardly folded side-walls connected to the frame by hinges, wherein each one of the folded side-walls has first and second panels hinged to each other, wherein the first and second panels are parallel to the door and the frame; and an angled, upper portion for fitting beneath an angled ceiling of a shelter when the hard-wall locker is unfolded into the assembled configuration;

wherein the locker further comprises a top member connected to the frame by a hinge, wherein the top member is configured to be rotated into a horizontal position when the hard-wall locker is in the assembled configuration;

wherein the hard-wall locker further comprises a back wall connected to the side-walls; and wherein the back wall includes first and second panels, wherein each one of the panels has a length, wherein the front door has a height, wherein the length of the first panel plus the length of the second panel is greater than the height of the frame, wherein the locker in the shipping configuration has no dimension greater than the height of the frame, and wherein the first panel is connected to the second panel by a horizontal hinge.

6. The hard-wall locker of claim 5, further comprising a shelf for supporting items in the locker in the assembled configuration.

7. The hard-wall locker of claim 5, further comprising a locking mechanism for securing the door to the frame when the locker is in the shipping configuration and when the locker is in the assembled configuration.

8. A method of unfolding, assembling, and positioning a hard-wall locker within a shelter, the method comprising:

providing the locker in a shipping configuration;

subsequently, opening a door of the locker;

folding side-walls of the locker outward by moving hinges of the side-walls away from each other; and locating the locker within a shelter, with an angled rear portion of the locker located under an angled portion of a ceiling of the shelter, and with the door facing forward, away from the rear portion of the locker.

9. The method of claim 8, further comprising moving a top member from a first position within the shipping configuration to a second position within an assembled configuration of the locker.

10. The method of claim 9, further comprising providing a back wall facing away from the door, with the rear portion of the locker being part of the back wall.

11. The method of claim 10, wherein the back wall has a combined length greater than a height of the locker in the assembled configuration, and greater than the largest dimension of the locker in the shipping configuration.

12. The method of claim 11, further comprising moving a shelf from a first position within the shipping configuration to a second position within the assembled configuration of the locker.

* * * * *